US010000368B2

(12) United States Patent
Haddix, II

(10) Patent No.: US 10,000,368 B2
(45) Date of Patent: Jun. 19, 2018

(54) HOIST SYSTEM FOR RETROFITTING SMALL SCISSOR LIFT TO ACCESS ENCLOSED AREAS IN BUILDING STRUCTURE

(71) Applicant: HOIST ALL, INC., San Diego, CA (US)

(72) Inventor: Donald E Haddix, II, Scottsdale, AZ (US)

(73) Assignee: HOIST ALL, INC., San Diego, CA (US)

( * ) Notice: Subject to any disclaimer, the term of this patent is extended or adjusted under 35 U.S.C. 154(b) by 65 days.

(21) Appl. No.: 14/120,722

(22) Filed: Jun. 20, 2014

(65) Prior Publication Data

US 2017/0015535 A1 Jan. 19, 2017

(51) Int. Cl.
*B66F 11/04* (2006.01)
*B66C 1/28* (2006.01)

(52) U.S. Cl.
CPC ..... *B66F 11/042* (2013.01); *B66C 1/28* (2013.01)

(58) Field of Classification Search
CPC . B66F 11/042; B66F 9/06; B66D 1/28; B66B 9/16
USPC ..... 254/323, 387; 182/63.1, 69.5, 141
See application file for complete search history.

(56) References Cited

U.S. PATENT DOCUMENTS 610,602 A * 9/1898 Doldt ..... B66F 11/042 182/102
1,342,982 A * 6/1920 Boehck ..... B66F 9/06 187/231
2,943,708 A * 7/1960 Sasgen ..... B66B 5/24 187/243
3,385,401 A * 5/1968 Campbell ..... B66B 9/16 187/222
3,860,092 A * 1/1975 Holmes ..... A62B 1/02 182/101
3,951,236 A 4/1976 Schreiber et al.
4,064,999 A * 12/1977 Young ..... E04F 21/1811 182/141
4,183,423 A * 1/1980 Lewis ..... B66B 9/16 182/103
4,391,345 A * 7/1983 Paul ..... B66F 11/042 182/141
4,491,449 A * 1/1985 Hawkins ..... B66F 3/22 182/141
4,560,074 A * 12/1985 Manning ..... B66C 23/203 212/179
4,614,251 A * 9/1986 Hawkins ..... B66F 7/0625 182/141
4,719,716 A * 1/1988 Chrisley, Jr. ..... E04H 1/1205 43/1
4,811,803 A * 3/1989 Green ..... A01M 31/02 180/7.5
4,987,976 A * 1/1991 Daugherty ..... B66B 9/16 16/331

(Continued)

FOREIGN PATENT DOCUMENTS

WO 2014066705 5/2014

*Primary Examiner* — Michael E Gallion

(74) *Attorney, Agent, or Firm* — Dentons US LLP

(57) ABSTRACT

A portable hoist assembly is mounted on a scissor lift. The hoist includes an elongate cable wound on a shaft. The cable has proximate and distal ends. A pulley is mounted on the cable intermediate the proximate and distal ends. In use, the pulley is secured to the ceiling of a building structure.

1 Claim, 3 Drawing Sheets

(56) References Cited

U.S. PATENT DOCUMENTS 5,107,954 A * 4/1992 Fujimoto ..... B66F 11/046 182/2.11
5,337,854 A * 8/1994 Brandt ..... B66F 11/044 182/2.9
5,431,526 A * 7/1995 Peterson ..... B60P 1/5433 212/223
5,549,176 A * 8/1996 Hawkins ..... E01D 21/00 182/150
5,595,265 A * 1/1997 Lebrocquy ..... A01M 31/02 187/244
5,927,432 A * 7/1999 Hershtik ..... B66B 9/00 182/141
6,371,449 B1 * 4/2002 Chamberlain ..... B25H 1/0014 254/10 C
6,460,653 B1 * 10/2002 Hardy ..... B60P 1/02 182/63.1
6,494,437 B1 * 12/2002 Boyer ..... B08B 9/0436 212/232
7,014,011 B1 * 3/2006 Alexander ..... B66B 9/16 182/145
7,182,173 B2 * 2/2007 Bailey ..... B66C 23/36 182/2.1
7,246,682 B1 * 7/2007 Hatch ..... E04D 15/00 182/102
7,513,333 B2 * 4/2009 Davis ..... E06C 5/02 182/115
7,909,139 B2 * 3/2011 Blue ..... A01M 31/02 182/103
7,913,978 B1 * 3/2011 Trihey ..... B66D 1/36 254/323
8,006,958 B2 * 8/2011 Starks ..... B66D 3/20 254/323
8,167,153 B1 5/2012 Wattel
9,371,217 B1 * 6/2016 DePumpo ..... B66F 9/20
9,604,827 B2 * 3/2017 Azzarelli ..... B66D 3/20
9,630,666 B1 * 4/2017 Keene ..... B62D 63/061
2002/0139613 A1 * 10/2002 Hardy ..... B60P 1/02 182/63.1
2004/0083660 A1 * 5/2004 Atkins ..... E06C 5/04 52/64
2005/0217025 A1 * 10/2005 Barattia ..... A61G 7/1015 5/86.1
2005/0232740 A1 * 10/2005 Cummings ..... B66F 11/042 414/680
2007/0045046 A1 * 3/2007 Hayes ..... A01M 31/02 182/63.1
2007/0089929 A1 * 4/2007 Schriewer ..... A01M 31/02 182/127
2010/0202868 A1 * 8/2010 Troy ..... B66D 1/60 414/809
2010/0308290 A1 12/2010 McGuffin
2012/0279801 A1 * 11/2012 Watson ..... A63B 21/157 182/19
2013/0112500 A1 * 5/2013 Keersmaekers ..... B66B 9/02 182/14
2015/0034893 A1 2/2015 Bacon et al.
2016/0016771 A1 * 1/2016 Whitaker ..... B66F 11/04 182/63.1

* cited by examiner

HOIST SYSTEM FOR RETROFITTING SMALL SCISSOR LIFT TO ACCESS ENCLOSED AREAS IN BUILDING STRUCTURE

This application pertains to a method and apparatus for lifting construction or other materials.

Those of skill in the art have, for many years, endeavored to provide improved apparatus and methodology to safely lift and maneuver construction materials.

Therefore, it would be highly desirable to provide an improved apparatus and method in this respect.

Therefore, it is a principal object of the instant invention to provide an improved apparatus and method to lift and position duct work and other construction materials.

This, and other and further objects of the invention will be apparent to those skilled in the art from the following detailed description thereof, taken in conjunction with the drawings, in which.

Figure 1:
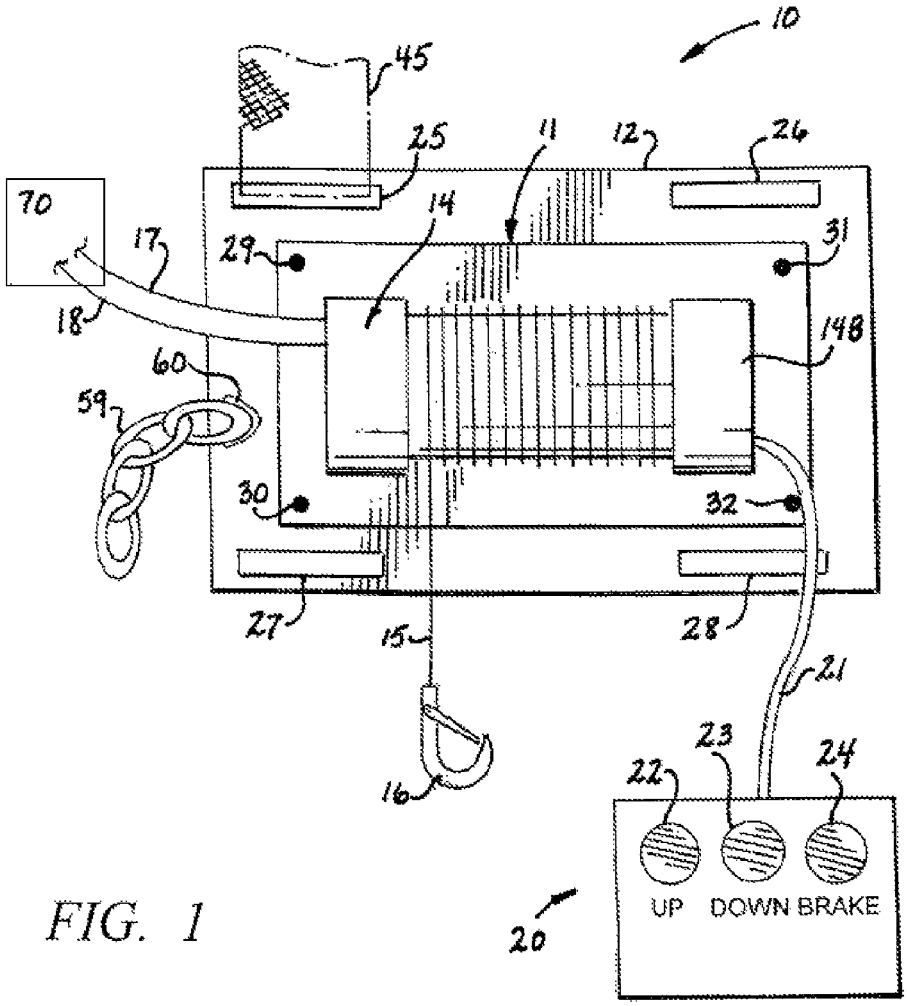
FIG. 1 is a front view illustrating a portable hoist used to retrofit a scissor lift in accordance with the principles of the invention.
Figure 2:
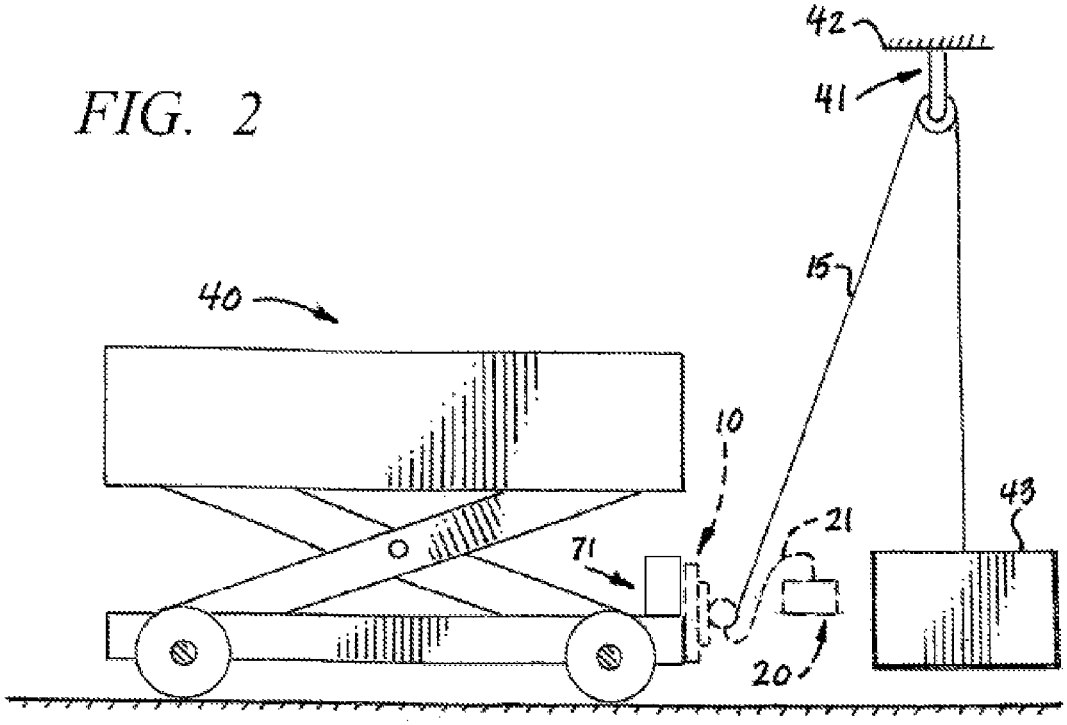
FIG. 2 is a side view illustrating the portable hoist of FIG. 1 mounted on a scissor lift in accordance with the invention.

Briefly, in accordance with the invention, provided is an improved portable hoist assembly to retrofit a scissor lift to elevate and position construction materials. The scissor lift includes at least one battery used in the operation of the scissor lift. The hoist assembly includes a hoist mounted on a support structure. The hoist includes a rotatable shaft, and an elongate cable wound on the shaft. The cable has a proximate end mounted on the shaft and a deployable distal end. The cable also includes a structure on the distal end to engage at least one item to be lifted by the hoist. The hoist also includes a motor connected to the shaft to rotate the shaft in at least two directions, a first forward direction to deploy the cable, and a second reverse direction to retract the cable. The hoist also includes an electrical cable having a proximate end connected to the motor and a distal end shaped and dimensioned to connect to the battery of the scissor lift to provide power needed to operate the motor. The hoist also includes a manually operated control unit connected to the motor to operate the hoist to deploy and retract the cable. The portable hoist assembly also includes at least one pulley mounted on the cable intermediate the proximate and distal ends of the cable; apparatus to secure the pulley to an overhead structure in a building; and, apparatus to detachably securely mount the support structure on the scissors lift.

Turning now to the drawings, which depict the presently preferred embodiments of the invention by way of illustration, and not limitation, of the invention, and in which like reference characters refer to corresponding elements throughout the several views, a new hoist system for a scissor lift is described with reference to the attached FIGS. 1 to 4, along with a method for utilizing the system. The new system is, when used in conjunction with a scissor lift, especially suited to lifting transformers, ducting, etc. in confined spaces in a building. Currently, lifting such pieces of construction equipment 43 and 44 in confined spaces is labor intensive, and can be relatively dangerous. The apparatus and method of the invention are believed to greatly facilitate and simplify such operations.

Figure 3:
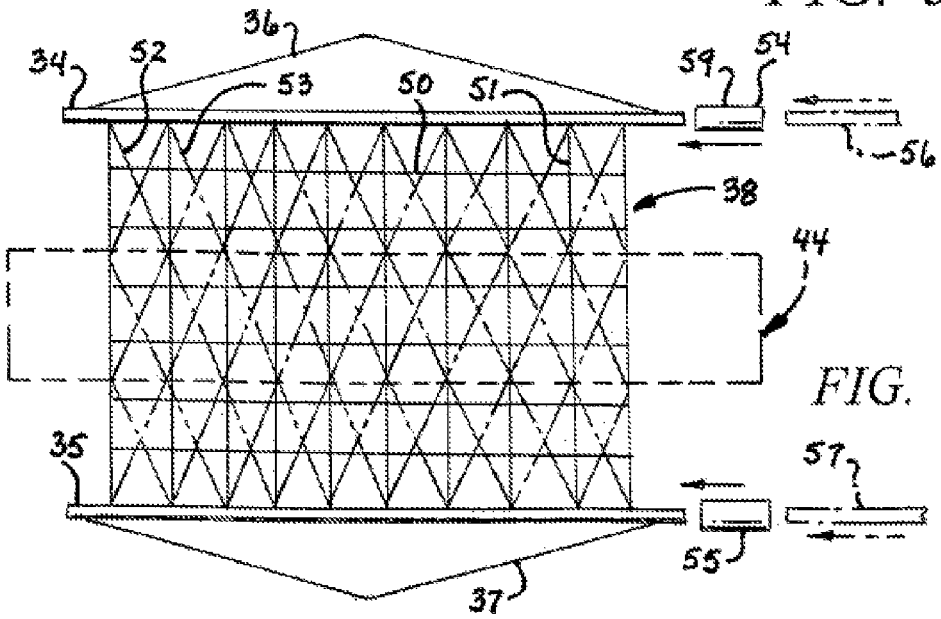
FIG. 3 is a top view illustrating a bridle utilized in one embodiment of the invention.
Figure 3A:
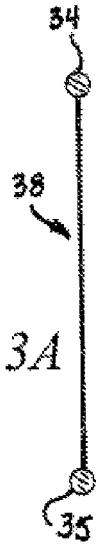
Figure 4:
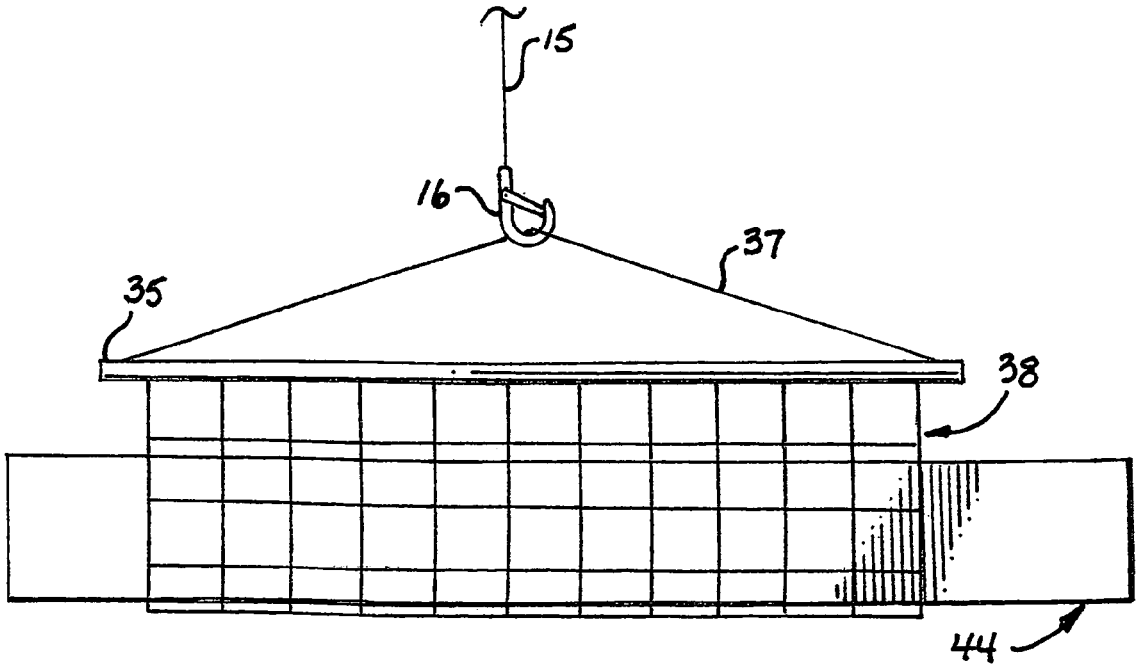
FIG. 4 is a slide elevation view of the bridle of FIG. 3 illustrating the mode of operation thereof.

A method utilized in accordance with one embodiment of the invention comprises the following steps:

1. A hoist assembly is obtained which includes a hoist 14 mounted on a plate 11 (FIG. 1) or some other support structure. The hoist assembly also includes a control unit 20 to operate an electric hoist motor 14B and includes electrical leads 17, 18. The hoist assembly also includes an extendible cable 15 with a hook 16 attached to the distal end of cable 15. Cable 15 is wound on shaft 14A. The proximate end of the cable 15 is, in conventional fashion, mounted on shaft 14A. Motor 14B turns shaft 14A in one direction to deploy cable 15 and turns shaft 14A in another direction to retract cable 15. Control unit 20 is connected to motor 14B by electrical lead or cable 21. Unit 20 is preferably manually held and operated to rotate shaft 14A to deploy cable 15, to rotate shaft 14A to retract cable 15, or to stop rotation of shaft 14A.
   a. The electrical leads 17, 18 are adapted to be attached to the battery(s) 70 or electrical system of a scissors lift 40 (FIG. 2) so that the batteries 71 of the scissors lift can be utilized to power the motor 14B hoist assembly.
   b. Plate 11, or another structure 12 attached to plate structure 11 or hoist 14, is configured to be mounted on a scissors lift 40 (FIG. 2) or other piece of equipment or other structure. The plate 11 (or structure 12) preferably is adapted to be removably mounted on the scissors lift 40. For example, in FIG. 1 plate structure 12 has slots 25, 26, 27, 28 formed through the plate so that each one of four attachment straps 45 can be threaded through a different one of slots 25 to 28 to engage a selected portion of a scissors lift 40 and secure detachably plate 12 (and therefore the hoist assembly) to scissors lift 40. Any desired method can be utilized to removably fasten plate 11 or another support structure 12 to a scissor lift 40.
   c. The hoist 14 is securely mounted to plate 11 or another structure 12 with bolts 29, 30, 31, 32 (FIG. 1), by welding, etc.
   d. The hoist assembly includes a pulley assembly which includes a pulley 41 (FIG. 2) that can be secured removably to a joist 42 or other overhead structure, and includes fastening means to secure the pulley assembly to the joist 42. The pulley assembly preferably is mounted on cable 15 and can move along cable 15 at locations intermediate the distal and proximate ends of cable 15. Consequently, when pulley 14 is fixedly removably attached to a joist 42 or other overhead structure, the wheel in pulley 14 turns freely when cable 15 moves through pulley 14.
2. A bridle or net structure 38 is obtained which includes netting 38 attached to and spanning between a pair of elongate poles 34, 35 (FIG. 3). The ends of a lift cable 36, 37 are attached to each pole 34, 35, respectively. The netting is sized to fit around a length of ducting 44 in the manner illustrated in FIG. 4. Netting 38 can include strands which are each perpendicular to or parallel to poles 34, 35 in the manner epitomized by strands 50 and 51. Importantly, it is preferred that the strands of netting 38 be canted with respect to poles 34, 35, as epitomized by the strands 52 and 53 drawn in dashed line form in FIG. 3. If desired, sleeves 54, 55 are provided and each removably fit or snap on an end of a pole 34 and 35 and also removably receive the end of an extension pole 56, 57, respectively.
3. The hoist assembly and the bridle 38 are packed together as a portable hoist kit for a scissors lift.

4. The portable hoist kit is transported to a building structure in which air conditioning ducting or other construction equipment is being suspended and installed.
5. A scissors lift 40 is provided at the building structure.
6. The four mounting straps are used to mount removably plate 12—and therefore the hoist assembly—on the scissors lift 40 in the manner illustrated in FIG. 2.
7. The pulley assembly 41, which preferably, but not necessarily, is already pre-installed on cable 15 so that cable 15 threads through assembly 41, is securely removably mounted on the overhead joist 42 of the building structure in the manner illustrated in FIG. 2.
8. Bridle 38 is laid on the floor in the manner illustrated in FIG. 3.
9. A length of ducting 44 is placed on the bridle 38 such that the ends of the ducting extend beyond the netting in the manner illustrated in FIG. 3.
10. Poles 34 and 35 are lifted off the floor.
11. Lift cables 36, 37 are each engaged with hook 16 in the manner illustrated in FIG. 4.
12. Control unit 20 is used to operate the hoist assembly to lift the bridle and ducting 44 off the floor to a desired height above the floor. When button 22 of unit 20 (FIG. 1) is manually depressed, motor 14B rotates shaft 14A in a direction which winds or retracts cable 15 onto shaft 14A. When button 23 of unit 20 is manually depressed, motor 14B rotates shaft 14A in a direction which deploys cable 15 from shaft 14A. When button 24 of unit 20 is manually depressed, rotation of shaft 14A stops.
13. A worker enters the basket of the scissors lift.
14. The scissors lift is operated to raise the basket so the worker can install the ducting 44.
15. If necessary, unit 20 is operated to adjust the height of ducting 44 above the floor.

Electrical wiring or leads 17 and 18 are presently preferably in the form of a fifty foot cable which at its distal ends (not shown) has alligator clips which can be attached to the posts of a battery.

Control unit 20, motor 14B, or another component in the system of the invention preferably includes a sensor which will prevent operation of motor 14B or of another portion of the system from operating if the weight being lifted exceeds a selected value. This value can vary but is presently 2000 pounds.

Cable 21 and the cable housing leads 17 and 18 are each preferably coiled (in the same manner that the cable leading from a telephone set to the telephone receiver is coiled) to reduce their length when not in use and to reduce the likelihood they will be run over or stepped on.

In one embodiment of the invention, hoist 14 includes a magnetic brake which clamps to and prevent rotation of shaft 14A as soon as button 24 is pressed or released, as the case may be. This is an important feature because it prevents ducting 44 or another article being lifted by the hoist assembly from moving a short distance (i.e., from "drifting") after motor 14A has been stopped. When motor 14A is stopped, it is preferred that the rotation of shaft 14A stop substantially immediately and completely.

In an alternate embodiment of the invention, the hoist assembly is not mounted on a scissor lift but is mounted on another piece of equipment or is mounted on the wall or ceiling of a building structure, for example in the bay of an automobile repair facility. Pulley 41 would normally then be mounted at a desired location on the ceiling of the bay.

In addition to straps 45, the hoist assembly also preferably includes one or more safety chains 59 which at one end are welded 60 or otherwise attached to a support structure 12 and are also secured to scissor lift 40 or to another piece of equipment or structure on which the hoist assembly is mounted.

While the size of hoist motor 14B utilized can vary as desired, the motor 14B ordinarily can be powered by four 12 volt or four 24 volt batteries wired in series. Each such battery may produce from thirty-six to forty-eight amps of current.

Having described the invention in such terms as to enable those skilled in the art to make and use the invention, and having described presently preferred embodiments thereof, I claim:

1. A portable hoist assembly to retrofit a scissor lift to elevate and position construction materials, the hoist assembly including:

(a) a hoist mounted on a support structure, said hoist including
  (i) a rotatable shaft,
  (ii) an elongate cable wound on said shaft, said cable having a proximate end mounted on said shaft and a deployable distal end,
  (iii) a structure on said distal end to engage at least one item to be lifted by said hoist,
  (iv) a motor connected to said shaft to rotate said shaft in at least two directions,
  a first forward direction to deploy said cable, and
  a second reverse direction to retract said cable,
  (v) an electrical lead having a proximate end connected to said motor and a distal end shaped and dimensioned to connect to a battery,
  (vi) a manually operated control unit connected to said motor to operate said hoist to deploy and retract said cable;

(b) at least one pulley mounted on said cable intermediate said proximate and distal ends of said cable; said at least one pulley configured to be secured to an overhead structure on a ceiling of a building;

(c) apparatus to detachably securely mount said support structure on the scissors lift.

* * * * *